United States Patent [19]

Yamazaki et al.

[11] Patent Number: 4,994,340

[45] Date of Patent: Feb. 19, 1991

[54] MAGNETIC TONER

[75] Inventors: Hiroshi Yamazaki; Yoko Yamamoto; Hirohiko Seki, all of Hachioji, Japan

[73] Assignee: Konica Corporation, Tokyo, Japan

[21] Appl. No.: 409,039

[22] Filed: Sep. 18, 1989

[30] Foreign Application Priority Data

Sep. 22, 1988 [JP] Japan ..... 63-239178

[51] Int. Cl.[5] ..... G03G 9/083; G03G 9/00; G03G 5/00; G03G 9/107

[52] U.S. Cl. ..... 430/106.6; 430/110; 430/111; 430/137

[58] Field of Search ..... 430/106.6, 110, 111, 430/137

[56] References Cited

U.S. PATENT DOCUMENTS

| | | | |
|---|---|---|---|
| 4,487,825 | 12/1984 | Gruber et al. | 430/106.6 |
| 4,565,766 | 1/1986 | Mitsuhashi et al. | 430/126 |
| 4,600,076 | 7/1986 | Terada et al. | 430/110 |

FOREIGN PATENT DOCUMENTS

| | | | |
|---|---|---|---|
| 0103967 | 3/1984 | European Pat. Off. | 430/111 |
| 0069151 | 5/1980 | Japan | 430/137 |
| 0117255 | 7/1985 | Japan . | |

*Primary Examiner*—Marion E. McCamish
*Assistant Examiner*—S. C. Crossan
*Attorney, Agent, or Firm*—Jordan B. Bierman

[57] ABSTRACT

A magnetic toner comprising at least a binder resin, a magnetic powder and polyolefine is disclosed. The magnetic toner comprises a Wadel's globularity ranging from 0.4 to 0.8, and polyolefine comprises a content ranging from 10 to 40 weight % on a surface of the toner.

10 Claims, No Drawings

MAGNETIC TONER

FIELD OF THE INVENTION

The present invention relates to a mono-component toner incorporating no carrier.

BACKGROUND OF THE INVENTION

The mono-component toner incorporating no carrier is subject to more strict requirements for performance in electrification of the toner itself than a dual component toner.

The mono-component toner is required to be sufficiently electrified between toners themselves or between the toner and a developing sleeve or an electrifying member in a developing machine. Improvement in fluidity has been proposed for improving electrification. For example, toner grains subjected to mere pulverization have an irregular shape and a smaller effective surface area involved in frictional electrification while having a large surface area, and therefore, a charge density of the toner is low. Further, magnetic flocculation occurs to degrade grain fluidity, thus adversely affecting toner electrification efficiency. Improvement in fluidity is therefore essential. For this purpose, some methods have been proposed, in which toner grains are subjected to a globularization treatment. There are disclosed thermal globularization methods in which toner surface is molten, such as a thermal globularization method disclosed in Japanese Patent O.P.I. Publication Nos. 52758/1981 and 127662/1984; a method in which surface of resin grains suspended in an air stream are molten to make them globular, disclosed in Japanese Patent O.P.I. Publication No. 134650/1983; and a method in which pulverization and globularization are simultaneously conducted at increased temperature, disclosed in Japanese Patent O.P.I. Publication NO. 616127/1986. Also known is a polymerization method in which spherical toner grains are obtained by polymerization, disclosed in Japanese Patent O.P.I. Publication Nos. 121048/1981.

It is preferable to add polyolefine to toner to improve an offset property of the toner.

However, unexpected problems are caused by the magnetic toner which contains polyolefine for improvement of the offset property and is subjected to the above-mentioned treatment. For example, in the thermal globularization method, an electrification of toner increases, but fringe images are formed due to formation of toner grains with reverse polarity, which in turn reduce the toner transfer rate. On the other hand, in the toner prepared by the polymerization method, there is a tendency where electrification of a toner does not increase as expected from a toner design.

SUMMARY OF THE INVENTION

An object of the present invention is to provide a magnetic toner having high electrification, good transfer rate and excellent fluidity. Another object of the invention is to provide a magnetic toner permitting formation of the images with excellent quality and density.

These objects can be accomplished by a toner prepared by controlling an amount of polyolefine present on toner surface and a toner shape (globularity).

Specifically, it has been found that the magnetic toner which comprises at least resin, magnetic powder and polyolefine and is characterized by a Wadel's true globularity ranging from 0.4 to 0.8 and a polyolefine content on a surface thereof ranging from 10 to 40 weight % has a good electrification characteristic. Accordingly, the magnetic toner of the present invention has a sufficiently large effective frictional surface area while having a small total surface area, and an excellent electrification characteristic which can be provided by controlling a polyolefine content on a surface.

DETAILED DESCRIPTION OF THE INVENTION

Toner binder resin and polyolefine are very different from each other in a molecular structure. It is, therefore, likely that in view of an electrification rank, intergrain frictional electrification property differs widely where different kinds of substances exist on a surface of the toner grains. Actually, detailed investigation of the conditions of a toner surface has revealed that there are significant differences in a polyolefine content on a toner surface between the toners prepared by the thermal globularization method in which toner surface is thermally molten, by the polymerization method, and by the simple pulverization method. In short, the polyolefine content on the surface is higher in the toner prepared by the thermal globularization method, while it is lower in the toner prepared by the polymerization method. It is assumed that the above matter significantly affects an electrification efficiency of a toner.

In the thermal globularization method, polyolefine melts at such temperature as promoting globularization due to a low melting point thereof, and deposits on a toner surface, which in turn leads to increase in the polyolefine content on the surface and to uneven distribution of the polyolefine content itself. If the substances with different electrification ranks are present on a toner surface, friction among toner grains becomes higher and a charge distribution widens; in addition, the toner is highly electrified but becomes bipolar, and results in a toner with a deteriorated transfer rate due to no transfer of a toner image because of the polarity reverse to that of a regular toner image transferred by a transfer electrode.

Meantime, in the polymerization method, almost no polyolefine deposits on a toner surface since a treating temperature is below a melting point of polyolefine, and therefore, the obtained toner is almost mono-polar and has an almost uniform surface. It is assumed that the toner grains having the same components are unlikely to be easily electrified by friction, which results in lowering significantly an inter-grain electrification efficiency and preventing an amount of electrification from efficiently increasing.

In the toner prepared by pulverization, polyolefine is present on a toner surface to a certain extent, but the electrification amount does not increase due to insufficient friction which is attributable to insufficient fluidity of the toner because of irregular shape thereof. Further, a charge density on a toner surface decreases since the toner has a small effective frictional surface area and the amount of electrification is small in comparison with a total surface area.

In the present invention, a globularity degree is obtained on the basis of Wadel's true globularity ($\psi$) calculated by the following equation:

$$\psi = \frac{\text{Theoretical specific surface area of assumptively spherical grains}}{BET \text{ specific surface area}}$$

wherein the theoretical specific surface area of the assumptively spherical grains can be calculated from a grain size distribution determined by a Coulter counter or other means on the assumption that the grains are truely spherical. The BET specific surface area is easily measurable by the nitrogen adsorption method. Globularity determined by this method is applicable to evaluation of surface roughness, so that it enables to compare actual roughness. Toner grains prepared by the above-mentioned thermal globularization method generally have a Wadel's true globularity ($\psi$) of not less than 0.8, while those prepared by the polymerization method generally have a value of not less than 0.85.

In the present invention, polyolefine content present on a toner surface can be determined by analyzing elements present on a surface based on ESCA.

ESCA analysis conditions are as follows;

Analyzer: PHI model 560 ESCA/SAM produced by Perkin-Elmer Co.

X-ray output: 15 kV, 26.7 mA

Sample preparation: the subject toner is spread over a piece of a two-side adhesive tape, which is fixed on a sample table.

For quantitative calculation, the peaks of the following elements are used to obtain the peak area for each element, Carbon = Cls Oxygen = Ols Iron = Fe2p which is corrected with a sensitivity coefficient, and the atomic concentrations of the components present on a toner surface are calculated. The sensitivity coefficients were cited from "Handbook of X-ray Photoelectron Spectroscopy", edited by Perkin-Elmer Co.

Then, a numerical ratio of the components present on the toner surface is calculated from the separately determined atomic concentrations of the respective components and the above determined atomic concentrations. The numerical ratio is multiplied by the molecular weights of the components to calculate a weight ratio.

In the present invention, the polyolefine content present on the surface was determined by this method.

Determination by this method revealed that the ratio of polyolefine present on the surface of the toner prepared by the thermal globularization method is generally over 50 weight %, while that of the toner prepared by the polymerization method is generally below 5 weight %. This ratio is more or less affected by an absolute amount of polyolefine contained in the toner, but a ratio change is not significant. It was also found that the ratio of polyolefine present on the surface of the toner prepared by the pulverization method generally falls between 10 and 40 weight %.

In the present invention, the term 'surface' is defined by the space between an outermost surface and a depth of about 0.1 $\mu$m therefrom. This definition is based on the fact that effective depth contributable to electrification of a toner is approximately 0.1 $\mu$m from the surface. In ESCA, a depth for measurement can be controlled by surface etching or other means.

A globularity less than 0.4 results in lowered electrification and a deteriorated image density and quality. This is because a charge density is low due to a large surface area, though it is partly attributable to reduction of fluidity of the toner itself.

The globularity exceeding 0.8 results in increasing in an effective frictional surface area of the toner and improving in electrification of the toner. However, when using the thermal globularization method to obtain such level of a globularity, a polyolefine distribution on a surface becomes ununiform, which results in a deteriorated transfer rate due to increase in a toner with a reverse polarity in spite of increase in electrification of the toner. The toner prepared by the polymerization method has an almost uniform surface, but a friction property and electrification thereof are low.

When a content of polyolefine present on a toner surface exceeds 40 weight %, the number of toner grains having different surface conditions increases to promote friction as well as bi-polarization, and a transfer rate and an image quality are deteriorated. When it is less than 10 weight %, deterioration of developability cannot be prevented even by raising a globularity and a surface charge density of the toner.

The toner of the invention is manufactured by kneading magnetic powder, resin, polyolefine, and if needed, a colorant and a charge controlling agent, pulverizing the mixture, and then subjecting it to globularization treatment (hereinafter referred to as hybrid treatment) by repeatedly applying mechanical impact force to the pulverized product. In the hybrid treatment, a toner is cooled to prevent the surface thereof from thermal degradation. For this purpose, it is preferable to maintain a toner temperature below a toner's glass transition point (70° C.). At a temperature below the toner's glass transition point, a molecular movement of the toner resin is inactive, and therefore, it is likely that polyolefine less compatible with the toner resin is less liable to causing phase separation and decreasing in an amount depositing on a toner surface. If the hybrid treatment is conducted at a temperature exceeding the toner's glass transition point, polyolefine on the toner surface increases to the extent that the ratio thereof becomes equal to that obtained by the thermal globularization. To obtain the toner of the invention, it is necessary to maintain a surface condition similar to that of the toner prepared by pulverization and conduct globularization by plastic deformation through the hybrid treatment. The equipments for hybrid treatment include a super mill, a ball mill, and an improved impact pulverizer such as a hybridizer. The toner of the invention is manufactured by subjecting a toner surface to plastic deformation with these means while cooling to prevent a temperature increase of the toner. :

The examples of the binder resin used in the invention include a styrene-acrylate copolymer resin prepared by copolymerization of a styrene monomer, an acrylate monomer such as butyl acrylate, and/or a methacrylate monomer such as methyl methacrylate; a polyester resin; a polyamide resin; a polyurethane resin; and a polyurea resin.

Polyolefine used in the invention preferably has a low molecular weight; polypropylene is especially preferable. Specifically, it is preferable to use polyolefine with an average molecular weight of 1,000 to 20,000 determined by a vapor osmotic pressure method. If an average molecular weight is too high, polyolefine dispersion in the toner may be poor, and a durability of developing agent and a durability and cleaning property of a fixing machine may be degraded. Meantime, if the average molecular weight is too low, the degree of tackiness increases to cause poor cleaning, reduction of a durability of a developing agent due to filming, and reduction of a durability of the fixing machine due to occurrence of an offset phenomenon.

It is preferable to use polyolefine whose softening point falls between 100° and 180° C., more preferably between 120 and 160° C., determined by the ring and ball method specified in JIS K2531-1960. If the softening point exceeds the upper limit, a fixability may become poor and a durability of the fixing machine decreases, or polyolefine dispersion in the toner may become poor to adversely affect a frictional electrification of the toner, which in turn may cause reduction of a durability of a developing agent. Meantime, if the softening point is below the lower limit, the offset phenomenon may occur to cause reduction of a durability and a cleaning property of the fixing machine, and reduction of a durability of the developing agent.

In the invention, it is preferable to use polyolefine having a melting viscosity ranging from 10 to 1000 cps, more preferably 50 to 500 cps, determined with a BL type viscometer.

A melting viscosity within the above range contributes to improvement in a transfer property, a fluidity, a cleaning property, an offset resistance and a durability.

A polyolefine content is preferably 0.2 to 10 parts by weight, more preferably 0.5 to 5 parts by weight per 100 parts by weight of a toner binder. An excessive content may cause poor cleaning due to excessive adhesion of polyolefine to a photoreceptor, reduction of a durability of a fixing machine due to adhesion of polyolefine to a heat roller, and reduction of a durability of a developing agent due to filming. Meantime, a too low content may cause reduction of a cleaning property and a durability of the fixing machine, and a durability of a developing agent.

It is also preferable that there exists a relationship represented by the following equation between a polyolefine content in a toner and a ratio of polyolefine present on a toner surface.

$$y = 10^{2(1-a)} \cdot x^{a}$$

$$0.3 < a < 2,\ 0.5 < x < 20 \text{ (weight \%)}$$

wherein y represents a ratio of polyolefine present on a toner surface; x represents a polyolefine content in a toner.

The examples of the magnetic material used for the invention include ferromagnetic metals such as iron, cobalt and nickel as well as ferrite and magnetite; alloys; and compounds containing these elements. In preparing a black toner, magnetite is especially preferable since it has a black color and serves as a colorant. These magnetic substances are uniformly dispersed in a resin in the form of fine power with an average grain size of 0.05 to 1 μm. A content thereof is 20 to 150 parts by weight, preferably 40 to 100 parts by weight per 100 parts by weight of a binder resin.

The examples of the colorants added to the binder resin include a yellow pigment, a magneta pigment and a cyan pigment, as well as black pigments such as carbon black (C.I. No. 77266), aniline black (C.I. No. 50440), furnace black (C.I. No. 77266) and lamp black (C.I. No. 77266). A content of these pigments is 1 to 20 parts by weight per 100 parts by weight of a binder resin.

A charge controlling agent may also be added to control a frictional electrification of a toner.

The examples of the charge controlling agents include a nigrosine dye, a metal complex dye, an ammonium salt compound and an aminotriphenylmethane dye.

A content of these charge controlling agents is 0 to 5 parts by weight per 100 parts by weight of a binder resin.

The toner of the invention may further contain inorganic fine grains as a fluidity improving agent. The examples of such inorganic fine powder include fine silica powder, alumina, titanium oxide, zinc oxide, clay, chromium oxide, magnesium oxide, barium sulfate and calcium carbonate. Fine silica powder is especially preferable.

Metal salt of fatty acid such as zinc stearate may be added to the toner in a ratio of 0.01 to 50 wt. % to improve a cleaning property in a cleaning system with a blade.

EXAMPLES

The present invention is hereinafter described in more detail by the examples. In the invention, 'part(s)' means 'part(s) by weight'.

EXAMPLE 1 (Toner 1)

There were kneaded 60 parts of a styrene-acrylate copolymer (composition: styrene/methyl methacrylate/butyl acrylate=75/10/15, weight-average molecular weight: $1.5\times10^5$, weight-average molecular weight/number-average molecular weight: 20), 40 parts of magnetic powder (magnetite, tradename BL-100, produced by Titanium Kogyo Co.), 3 parts of polypropylene 1 (softening point: 145° C., melting viscosity at 160° C.: 70 cps, average molecular weight: 3000) and 3 parts of a charge controlling agent (nigrosine dye, tradename Nigrosine SO, produced by Orient Kagaku Kogyo Co.); the mixture was pulverized and classified to obtain Grain 1 with a volume-average grain size of 11.5 μm. Grain 1 had a globularity of 0.33, a glass transition point of 58° C., and a surface polypropylene content of 29 weight %. Grain 1 was mechanically impacted with a hybridizer produced by Nara Machinery Co., a modified impact pulverizer, while regulating an inside temperature below 55° C. by introducing cool air, whereby a form and a surface were reformed to obtain Grain A. Grain A had a globularity of 0.06 and a surface polypropylene content of 35 weight % determined by ESCA. To 100 parts of Grain A were added 0.3 parts of hydrophobic silica (tradename R-972, produced by Aerosil Co.) and 0.3 parts of zinc stearate, and mixed with a turbular mixer to prepare Toner 1.

EXAMPLE 2 (Toner 2)

Example 1 was repeated to prepare Grain B, except that the mechanical impact force and treating time were changed and that the inside temperature of the machine was maintained below 50° C. Grain B had a globularity of 0.77 and a surface polypropylene content of 38 weight %. To 100 parts of Grain B were added 0.3 parts of hydrophobic silica (tradename R-952, produced by Aerosil Co.) and 0.3 parts of zinc stearate, and mixed with a turbular mixer to prepare Toner 2.

EXAMPLE 3 (Toner 3)

Grain 2 was prepared in the same manner as Example 1 , except that the polypropylene 1 content was changed to 1 part. Grain 2 had a volume-average grain size of 11.0 μm, a globularity of 0.34, a glass transition point of 59° C., and a surface polypropylene content of 11 weight %. Grain C was prepared in the same manner as Example 1, except that Grain 2 was used instead of Grain 1. Grain C had a globularity of 0.55, and a surface polypropylene content of 12 weight %. To 100 parts of Grain C were added 0.3 parts of hydrophobic silica (tradename R-972, produced by Aerosil Co.) and 0.3 parts of zinc stearate, and mixed with a turbular mixer to prepare Toner 3.

EXAMPLE 4 (Toner 4)

Grain 3 was prepared in the same manner as Example 1, except that 2 parts of polypropylene 2 (softening point: 150° C., melting viscosity at 160° C.: 200 cps, average molecular weight: 4000) was used in place of polypropylene 1. Grain 3 had a volume-average grain size of 11.0 μm, a globularity of 0.31, a glass transition point of 59° C., and a surface polypropylene content of 35 weight %. Grain D was prepared in the same manner as Example 1, except that Grain 3 was used instead of Grain 1. Grain D had a globularity of 0.49 and a surface polypropylene content of 24 weight %. To 100 parts of Grain D were added 0.3 parts of hydrophobic silica (tradename R-972, produced by Aerosil Co.) and 0.3 parts of zinc stearate, and mixed with a turbular mixer to prepare Toner 4.

EXAMPLE 5 (Toner 5)

Grain 4 was prepared in the same manner as Example 1, except that polypropylene 2 was used in place of polypropylene 1. Grain 4 had a volume-average grain size of 11.8 μm, a glass transition point of 59° C., a globularity of 0.32, and a surface polypropylene content of 32 weight %. Grain E was prepared in the same manner as Example 1, except that Grain 4 was used in place of Grain 1. Grain E had a globularity of 0.56 and a surface polypropylene content of 32 weight %. To 100 parts of Grain E were added 0.3 parts of hydrophobic silica (tradename R-972, produced by Aerosil Co.) and 0.3 parts of zinc stearate, and mixed with a turbular mixer to prepare Toner 5.

EXAMPLE 6 (Toner 6)

Grain F was prepared in the same manner as Example 1, except that Grain 4 was used in place of Grain 1 and that the mechanical impact force and treating time were changed. Grain F had a globularity of 0.45 and a surface polypropylene content of 33 weight %. To 100 parts of Grain F were added 0.3 parts of hydrophobic silica (tradename R-972, produced by Aerosil Co.) and 0.3 parts of zinc stearate, and mixed with a turbular mixer to prepare Toner 6.

EXAMPLE 7 (Toner 1)

To 100 parts of Grain 1 prepared in Example 1 were added 0.3 parts of hydrophobic silica (tradename R-972, produced by Aerosil Co.) and 0.3 parts of zinc stearate, and mixed with a turbular mixer to prepare Comparative Toner 1.

EXAMPLE 8 (Comparative Toner 2)

Grain 1 was passed through a hot air flow at 400° C. in a spray drier to prepare Grain a. Grain a had a globularity of 0.90 and a surface polypropylene content of 67 weight %. To 100 parts of Grain a were added 0.3 parts of hydrophobic silica (tradename R-972, produced by Aerosil Co.) and 0.3 parts of zinc stearate, and mixed with a turbular mixer to prepare Comparative Toner 2.

EXAMPLE 9 (Comparative Toner 3)

To 75 parts of styrene monomer, 10 parts of methyl methacrylate monomer and 15 parts of butyl acrylate monomer were added 3 parts of polypropylene 1 of Example 1, 3 parts of a charge controlling agent (nigrosine dye, tradename Nigrosine SO, produced by Orient Kagaku Kogyo Co.), 50 parts of magnetic powder (magnetite, tradename BL-100, produced by Titanium Kogyo Co.) and 3 parts of azobisisobutyronitrile as a polymerization initiator. This mixture was thoroughly dispersed and uniformized with a sand grinder. The dispersion was added to an aqueous solution containing collidal tricalcium phosphate and sodium dodecylbenzenesulfonate as dispersion stabilizers while agitating the solution at high rate with a homomixer or other means, and was emulsified in oil drops with a diameter of about 11 μm. The temperature was then raised to 60° to 70° C., and polymerization was conducted for about 6 hours. The emulsion was then broken by addition of dilute hydrochloric acid, and resin particles were washed and dried to obtain Grain b. Grain b had a globularity of 0.93 and a surface polypropylene content of 4 weight %. To 100 parts of Grain b were added 0.3 parts of hydrophobic silica (tradename R-972, produced by Aerosil Co.) and 0.3 parts of zinc stearate, and mixed with a turbular mixer to prepare Comparative Toner 3.

EXAMPLE 10 (Comparative Toner 4)

Grain 5 was prepared in the same manner as Example 1, except that an amount of polypropylene 1 was changed from 3 parts to 0.4 parts. Grain 5 had a volume-average grain size of 11.0 μm, a globularity of 0.34, a glass transition point of 59° C., and a surface polypropylene content of 7 weight %. Grain c was prepared in the same manner as Example 1, except that Grain 5 was used instead of Grain 1. Grain c had a globularity of 0.52 and a surface polypropylene content of 8 weight %. To 100 parts of Grain c were added 0.3 parts of hydrophobic silica (tradename R-972, produced by Aerosil Co.) and 0.3 parts of zinc stearate, and mixed with a turbular mixer to prepare Comparative Toner 4.

EXAMPLE 11 (Comparative Toner 5)

Grain 6 was prepared in the same manner as Example 1, except that an amount of polypropylene 1 was changed from 3 parts to 11 parts. Grain 6 had a volume-average grain size of 11.9 μm, a globularity of 0.32, a glass transition point of 57° C., and a surface polypropylene content of 41 weight %. Grain d was prepared in the same manner as Example 1, except that Grain 6 was used instead of Grain 1. Grain d had a globularity of 0.62 and a surface polypropylene content of 43 weight %. To 100 parts of Grain d were added 0.3 parts of hydrophobic silica (tradename R-972, produced by Aerosil Co.) and 0.3 parts of zinc stearate, and mixed with a turbular mixer to prepare Comparative Toner 5.

The properties of the magnetic toners were rated as follows; the evaluation was conducted at a normal temperature and a normal humidity.

Monopolarity: an amount of a toner sticked to a photoreceptor was measured using a copying machine equipped with:

a developing unit having a stainless steel sleeve (diameter 24 mm) with a built-in 8 electrode magnet roll, and a non-magnetic doctor blade; and a photoreceptor of photosemiconductor; in the conditions of:

rotation of the magnet roll: 1000 rpm;

rotation of the sleeve: 250 rpm;

a developing gap: 0.3 mm;

a gap of the doctor blade: 0.3 mm;

a bias voltage between the developing unit and the photoreceptor: ±500 V. The degree of mono-polarity (MP value) was calculated from the following equation:

$$MP \text{ value} = \frac{\text{sticked amount of toner under positive voltage}}{\left(\begin{array}{c}\text{sticked amount of toner}\\ \text{under positive voltage}\end{array}\right) + \left(\begin{array}{c}\text{sticked amount of toner}\\ \text{under negative voltage}\end{array}\right)}$$

This value increases as the degree of mono-polarity increases. Completely mono-polar toner has an MP value of 1.0.

Developability: a solid black image was copied with U-Bix 1200 manufactured by Konica Corp. equipped with a polyurethane blade cleaning unit, a heat roller fixing unit and a developing unit for a monocomponent toner in a surface voltage of −500 V on a photoreceptor. An average value was calculated from the reflection densities measured on the eight points arbitrarily selected on the copied image with a Macbeth densitometer (MacbethRD 914).

Transfer rate: character images with an image element ratio of 5% were printed under the same conditions as those for developability evaluation. The transfer rate was calculated from a toner consumption and recovery after 1000 sheets were printed.

Image quality: character images with an image element ratio of 5% were printed under the same conditions as those for developability evaluation. The printed characters were visually observed for dusts thereabout and classified to 5 ranks of A through E;

A: no problem in practical use,

B: only a few dusts observed,

C: average and allowable,

D: some problems in practical use, and

E: no practicability

Fluidity: fluidity was rated by a static bulk density measured with a tap densor produced by Seishin Kogyo Co.

The results are shown in Table 1.

TABLE 1

| Sample | Toner | Globularity | Surface PP* content | MP value | Density | Transfer rate | Image Quality | Static bulk density |
|---|---|---|---|---|---|---|---|---|
| Example 1 Inv. | Toner 1 | 0.60 | 35 wt % | 0.75 | 1.43 | 95% | A | 0.72 |
| 2 Inv. | Toner 2 | 0.77 | 38 wt % | 0.71 | 1.42 | 94% | A | 0.71 |
| 3 Inv. | Toner 3 | 0.55 | 12 wt % | 0.77 | 1.41 | 91% | A | 0.70 |
| 4 Inv. | Toner 4 | 0.49 | 24 wt % | 0.76 | 1.44 | 92% | A | 0.72 |
| 5 Inv. | Toner 5 | 0.56 | 32 wt % | 0.66 | 1.44 | 90% | A | 0.70 |
| 6 Inv. | Toner 6 | 0.45 | 33 wt % | 0.66 | 1.40 | 89% | A | 0.70 |
| 7 Comp. | Comparative toner 1 | 0.33 | 29 wt % | 0.65 | 1.10 | 68% | D | 0.63 |
| 8 Comp. | Comparative toner 2 | 0.90 | 67 wt % | 0.56 | 1.02 | 58% | E | 0.66 |
| 9 Comp. | Comparative toner 3 | 0.93 | 4 wt % | 0.88 | 1.15 | 66% | D | 0.75 |
| 10 Comp. | Comparative toner 4 | 0.52 | 8 wt % | 0.72 | 1.11 | 69% | D | 0.69 |
| 11 Comp. | Comparative toner 5 | 0.62 | 43 wt % | 0.55 | 1.03 | 61% | E | 0.68 |

Note:
PP polypropylen

These results demonstrate that the toner of the invention has excellent fluidity and transfer property, and capable of forming the images with high density and high quality.

In Toner 1 through 6, the fixing property was good without causing either offset phenomenon or poor cleaning; high image quality was maintained even after copying was repeated in 30,000 cycles.

What is claimed is:

1. A magnetic toner comprising a binder resin, a magnetic powder, and a polyolefin, wherein said magnetic toner has a Wadel's globularity of 0.4 to 0.8, and the surface of the toner contains 10–40% by weight of polyolefin as measured by ESCA.

2. The magnetic toner of claim 1 wherein said polyolefin has an average molecular weight of 1,000 to 20,000.

3. The magnetic toner of claim 2 wherein said polyolefin has a softening point of 100° to 180° C.

4. The magnetic toner of claim 3 wherein said softening point is 120° to 160° C.

5. The magnetic toner of claim 3 wherein said polyolefin has a melt viscosity of 10 to 1,000 cps at 160° C.

6. The magnetic toner of claim 5 wherein said melt viscosity is 50 to 500 cps.

7. The magnetic toner of claim 5 wherein said polyolefin is 0.2 to 10 parts by weight per 100 parts by weight of said binder resin.

8. The magnetic toner of claim 7 wherein said polyolefin is 0.5 to 5 parts by weight per 100 parts by weight of said binder resin.

9. The magnetic toner of claim 7 wherein said polyolefin is polypropylene.

10. The magnetic toner of claim 1 wherein said binder resin is a styrene-acrylate copolymer, a polyester resin, a polyamide resin, a polyurethane resin, or a polyurea resin.

* * * * *